US007706721B2

(12) United States Patent
Kim et al.

(10) Patent No.: US 7,706,721 B2
(45) Date of Patent: Apr. 27, 2010

(54) ELECTROPHOTOGRAPHIC IMAGE FORMING DEVICE HAVING FUSING UNIT AND SUPPORTING PART TO SUPPORT FUSING UNIT

(75) Inventors: Young-min Kim, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 576 days.

(21) Appl. No.: 11/282,674

(22) Filed: Nov. 21, 2005

(65) Prior Publication Data

US 2006/0140675 A1 Jun. 29, 2006

(30) Foreign Application Priority Data

Dec. 23, 2004 (KR) ..... 10-2004-0111153

(51) Int. Cl.
*G03G 15/20* (2006.01)

(52) U.S. Cl. ..... 399/122

(58) Field of Classification Search ..... 399/122, 399/328

See application file for complete search history.

(56) References Cited

U.S. PATENT DOCUMENTS

| | | | | |
|---|---|---|---|---|
| 5,842,085 | A * | 11/1998 | Mitsuya | 399/122 |
| 6,314,256 | B1 * | 11/2001 | Saitoh | 399/122 |
| 6,643,483 | B1 * | 11/2003 | Hirabayashi | 399/124 |
| 6,990,303 | B2 * | 1/2006 | Suzuki | 399/122 |
| 7,027,075 | B2 * | 4/2006 | Yokoi | 347/156 |
| 7,440,713 | B2 * | 10/2008 | Sone et al. | 399/122 |
| 2003/0103779 | A1 * | 6/2003 | Yokoyama | 399/122 |
| 2004/0165911 | A1 * | 8/2004 | Suzuki | 399/122 |
| 2004/0190939 | A1 * | 9/2004 | Yamanaka | 399/122 |
| 2005/0031376 | A1 * | 2/2005 | Suzuki | 399/122 |

FOREIGN PATENT DOCUMENTS

| | | | |
|---|---|---|---|
| JP | 4-116678 | | 4/1992 |
| JP | 04223488 | A * | 8/1992 |
| JP | 11-24529 | | 1/1999 |
| JP | 2002169390 | A * | 6/2002 |
| JP | 2003005575 | A * | 1/2003 |
| KR | 1998-19703 | | 6/1998 |
| KR | 2000-63032 | | 10/2000 |
| KR | 10-3952522 | | 8/2003 |

OTHER PUBLICATIONS

Computer translation of JP2002-169390a.*
Korean Office Action dated Mar. 23, 3006 issued in KR 2004-111153.

* cited by examiner

*Primary Examiner*—Quana M Grainger
(74) *Attorney, Agent, or Firm*—Stanzione & Kim, LLP

(57) ABSTRACT

An electrophotographic image forming device includes an image forming unit to apply a developer to a paper and to form an image thereon. The electrophotographic image forming device further includes a fusing unit having a fusing roller to receive the paper from the image forming unit, to fix the developer on the paper, and to move the paper, and a housing containing the image forming unit, and having a fusing unit accommodating part to detachably receive the fusing unit along a direction that is different than a paper transfer direction to be accommodated therein. Thus, the electrophotographic image forming device allows the fusing unit to be detachably mounted therein safely and conveniently.

8 Claims, 5 Drawing Sheets

ELECTROPHOTOGRAPHIC IMAGE FORMING DEVICE HAVING FUSING UNIT AND SUPPORTING PART TO SUPPORT FUSING UNIT

CROSS-REFERENCE TO RELATED APPLICATIONS

This application claims the benefit of Korean Patent Application No. 2004-111153, filed on Dec. 23, 2004, in the Korean Intellectual Property Office, the disclosure of which is incorporated herein by reference in its entirety.

BACKGROUND OF THE INVENTION

1. Field of the Invention

The present general inventive concept relates to an electrophotographic image forming device, and more particularly, to an electrophotographic image forming device having a fusing unit, which is safely detachably mounted therein.

2. Description of the Related Art

Generally, an electrophotographic image forming device comprises a paper supplying unit, an image forming unit, a fusing unit, and a paper discharging unit. As the paper supplying unit supplies a paper to the image forming unit, the image forming unit selectively applies a developer to the paper using a potential difference, thereby forming a developer image thereon. The fusing unit fixes the developer to the paper to set the developer image. The paper discharging unit receives the paper with the developer fixed thereon from the fusing unit and discharges the paper outside the electrophotographic image forming device.

The fusing unit comprises a couple of fusing rollers that rotate opposite to one another through which the paper is transferred for applying heat and pressure thereto. As the fusing rollers having a heating apparatus perform a fusing operation, a high temperature is produced. The developer that is applied to the paper is fixed thereto by the fusing rollers that apply the heat and pressure. However, when the fusing unit operates abnormally, which may be caused by expiration of its lifespan, the developer may be fixed on the paper without stability and may be exfoliated therefrom.

When the lifespan of the fusing unit expires, the fusing unit is removed from a main body of the electrophotographic image forming device and is replaced. The lifespan of the fusing unit is typically shorter than a life span of the electrophotographic image forming device. In particular, as the life span of the electrophotographic image forming device increases (as it has in relatively recent years), the fusing unit becomes expendable. Moreover, it becomes necessary for the fusing unit to be detachable from the main body of the electrophotographic image forming device in case that a paper gets jammed, a malfunction occurs in the fusing unit or surrounding components, or the lifespan of the fusing unit expires. Furthermore, it is important that the fusing unit be detachably mounted thereon safely and conveniently.

FIG. 1 is a perspective view schematically illustrating a conventional electrophotographic image forming device. As illustrated in FIG. 1, the conventional electrophotographic image forming device includes a fusing unit 2 mounted in a housing 1. The fusing unit 2 can be detached from housing 1 when the lifespan of the fusing unit 2 expires, or when the fusing unit 2 or the conventional electrophotographic image forming device needs to be repaired. A user can typically remove some parts of the housing 1, disassemble a coupling member (not shown) that couples the fusing unit 2 to the housing 1, and then detach the fusing unit 2 along a paper transfer direction (direction A), which is perpendicular to a rotational axis of a fusing roller 3 of the fusing unit 2.

However, the conventional electrophotographic image forming device has the following problems.

First, when the user holds the fusing unit 2 when detaching it from the housing 1, the user may come into contact with the fusing roller 3, which may be very hot, thereby possibly getting burned. Since an entire length of the fusing roller 3 is exposed to the user when the fusing unit 2 is detached from the housing 1, it is easy for the user to accidentally contact the fusing roller 3 and get burned.

Second, there is a need for the coupling member (e.g., a screw) to attach the fusing unit 2 to the housing 1. The coupling member should be able to withstand a resistance produced by the paper being transferred and a centrifugal force of the fusing roller 3, because a detachment direction of the fusing unit 2 is the same as that of a rotation direction of the fusing roller 3 and the paper transfer direction. Thus, in order to mount/detach the fusing unit 2 in/from the housing 1, the user is required to assemble or disassemble the coupling member of the housing 1. This can be difficult and inconvenient for the user. Further, the coupling member may get lost when it is disassembled from the housing 1 and the fusing unit 2 is detached.

Third, the fusing unit 2 is typically located in a back of the housing 1 according to the conventional electrophotographic image forming device. Thus, the fusing unit 2 is mounted/detached in the back of the housing 1 resulting in poor accessibility. Additionally, since the conventional electrophotographic image forming device is typically arranged so that the back thereof faces a wall, the user is required to move the conventional electrophotographic image forming device in order to mount or detach the fusing unit 2. This also causes the user an inconvenience and may be difficult, especially when the conventional electrophotographic image forming device is large

SUMMARY OF THE INVENTION

The present general inventive concept provides an electrophotographic image forming device that allows a fusing unit to be detachably mounted therein safely and conveniently.

Additional aspects of the present general inventive concept will be set forth in part in the description which follows and, in part, will be obvious from the description, or may be learned by practice of the present general inventive concept.

The foregoing and/or other aspects of the present general inventive concept are achieved by providing an electrophotographic image forming device having an image forming unit to apply a developer to a paper to form an image thereon. The electrostatic image forming device further includes a fusing unit having a fusing roller to receive the paper from the image forming unit, to fix the developer on the paper, and to move the paper, and a housing containing the image forming unit, and having a fusing unit accommodating part to detachably receive the fusing unit along a direction that is different than a paper transfer direction to be accommodated therein.

The fusing unit accommodating part may detachably receive the fusing unit along a rotational axis of the fusing roller.

The housing may further comprise a fusing unit gateway positioned at an end of to the fusing unit accommodating part to allow the fusing unit be moved in and out of the fusing unit accommodating part therethrough.

The electrophotographic image forming device may further comprise a movable fusing unit supporting part movably installed in the fusing unit accommodating part to detachably support the fusing unit and to move between a mounting position in which the fusing unit is accommodated in the fusing unit accommodating part and a detaching position in which the fusing unit is exposed out of the housing and is detachable therefrom by being moved through the fusing unit gateway.

The electrophotographic image forming device may further comprise a rail part interposed between the movable fusing unit supporting part and the fusing unit accommodating part to allow the movable fusing unit supporting part to move smoothly between the mounting position and the detaching position.

The rail part may comprise a deviation preventer disposed at an end thereof in the fusing unit gateway to prevent the movable fusing unit supporting part from exceeding the detaching position and to prevent the movable fusing unit supporting part from deviating from the housing.

The movable fusing unit supporting part may comprise a holding part at an end that corresponds to the fusing unit gateway when in the mounting position.

The fusing unit may further comprise a connecting part at an end thereof that is first received in the fusing unit accommodating part, and the fusing unit accommodating part may comprise a delivering part disposed to connect with the connecting part as the fusing unit is received in the fusing unit accommodating part and to deliver to the fusing unit at least one of a power, a driving force, and an electric signal.

The electrophotographic image forming device may further comprise a mounting position regulator interposed between the fusing unit accommodating part and the fusing unit to regulate a position in which the fusing unit is accommodated therein.

The electrophotographic image forming device may further comprise a fusing unit mounting sensor to sense a state of the fusing unit including whether the fusing unit is accommodated in the fusing unit accommodating part, an indicating part to indicate the state of the fusing unit, and a controlling part to receive the state of the fusing unit from the fusing unit mounting sensor and to control the indicating part to indicate the state of the fusing unit.

The electrophotographic image forming device may further comprise a gateway cover to open or close the fusing unit gateway.

The gateway cover may be coupled to the housing by a hinge to rotatably open and close the fusing unit gateway.

The electrophotographic image forming device may further comprise a gateway sensor to sense a state of the gateway cover including whether the gateway cover is open, an indicating part to indicate the state of the gateway cover, and a controlling part to receive the state of the gateway cover from the gateway sensor and to control the indicating part to indicate the state of the gateway cover.

The fusing unit may further comprise a handle formed at an end thereof that corresponds to the fusing unit gateway when in the mounting position.

The foregoing and/or other aspects of the present general inventive concept may also be achieved by providing a fusing device usable in an electrophotographic image forming device and to be integrated with components installed in a housing thereof. The fusing device comprises a fusing unit having one or more fusing rollers to apply heat and pressure to a paper, and a movable support part to movably support the fusing unit between a mounted position in which the movable support part supports the fusing unit in the housing and a detached position in which the movable support part supports the fusing unit out of the housing.

The foregoing and/or other aspects of the present general inventive concept may also be achieved by providing an electrophotographic image forming device, comprising: a housing including front, rear, and side panels, and a fusing unit gateway disposed on one of the side panels to receive a fusing unit having one or more fusing rollers to be mounted in the housing.

The foregoing and/or other aspects of the present general inventive concept may also be achieved by providing an electrophotographic image forming device, comprising: a housing, a fusing unit supporting part to move between a first position inside the housing and a second position outside the housing, and a fusing unit to be detachably disposed in the fusing unit supporting part when the fusing unit supporting part is in the second position.

The foregoing and/or other aspects of the present general inventive concept may also be achieved by providing an electrophotographic image forming device, comprising: a housing, a receiving part disposed in the housing, a rail unit formed in the housing, a fusing unit, and a fusing unit supporting part to move along the rail unit to position the fusing unit between a mounting position and a detaching position.

BRIEF DESCRIPTION OF THE DRAWINGS

The above and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
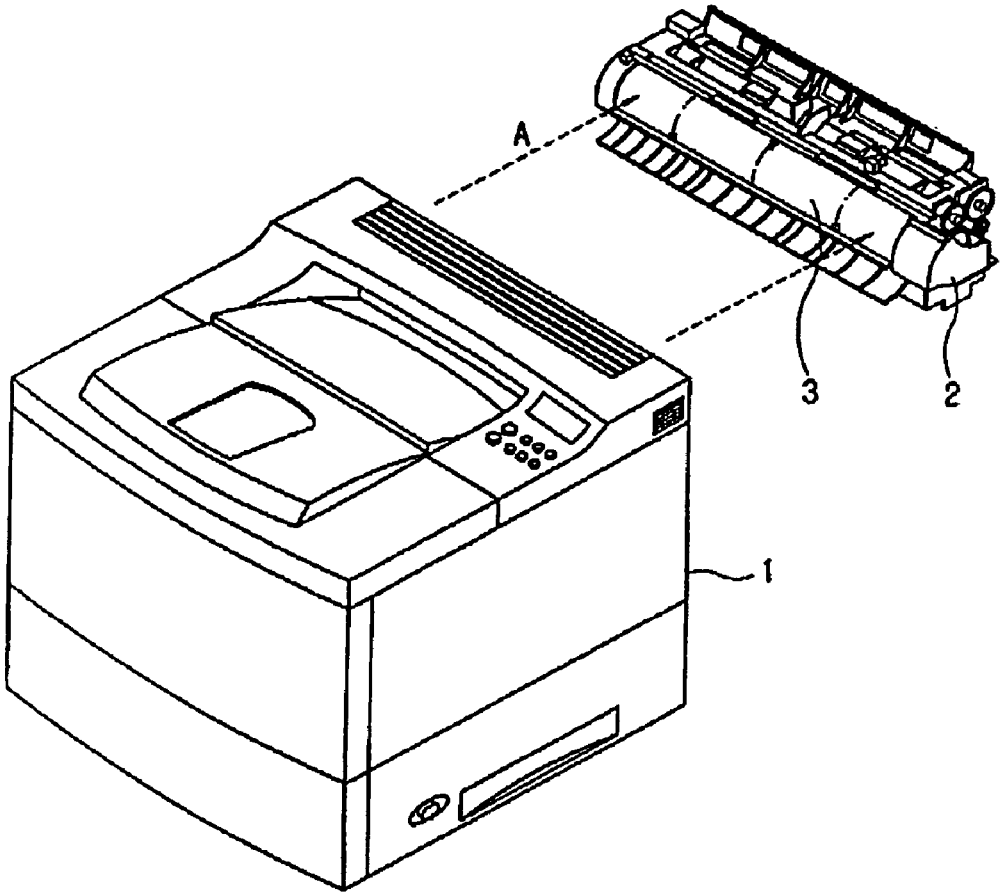
FIG. 1 (PRIOR ART)
FIG. 1 is a perspective view schematically illustrating a conventional electrophotographic image forming device.

Reference will now be made in detail to the embodiments of the present general inventive concept, examples of which are illustrated in the accompanying drawings, wherein like reference numerals refer to like elements throughout.

Figure 2:
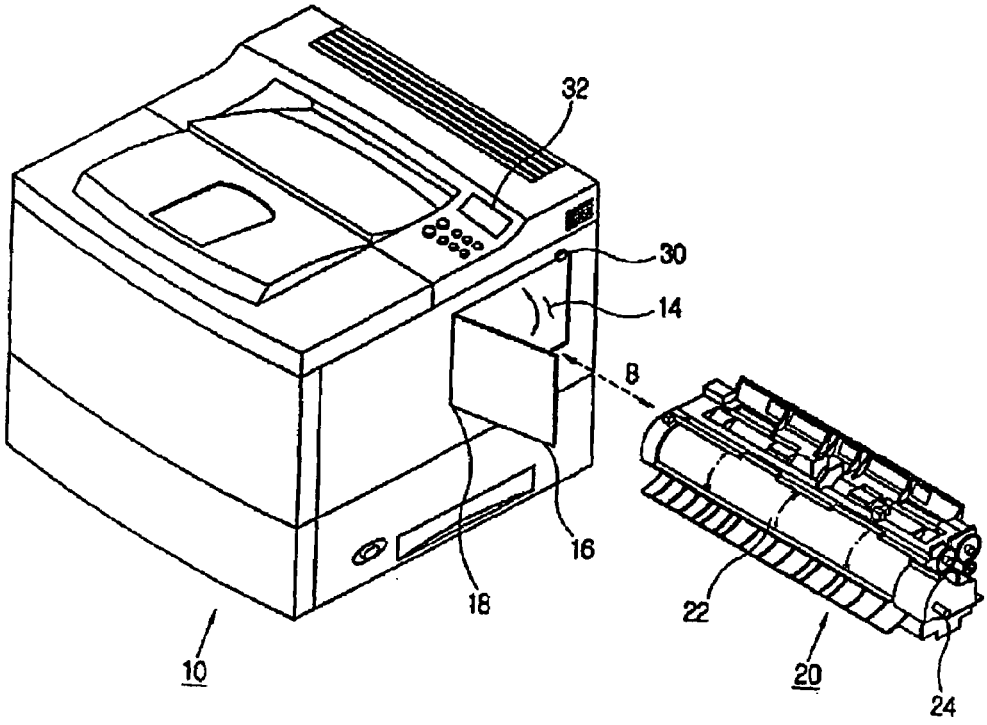
FIG. 2 is a perspective view schematically illustrating an electrophotographic image forming device according to an embodiment of the present general inventive concept.
Figure 3A:
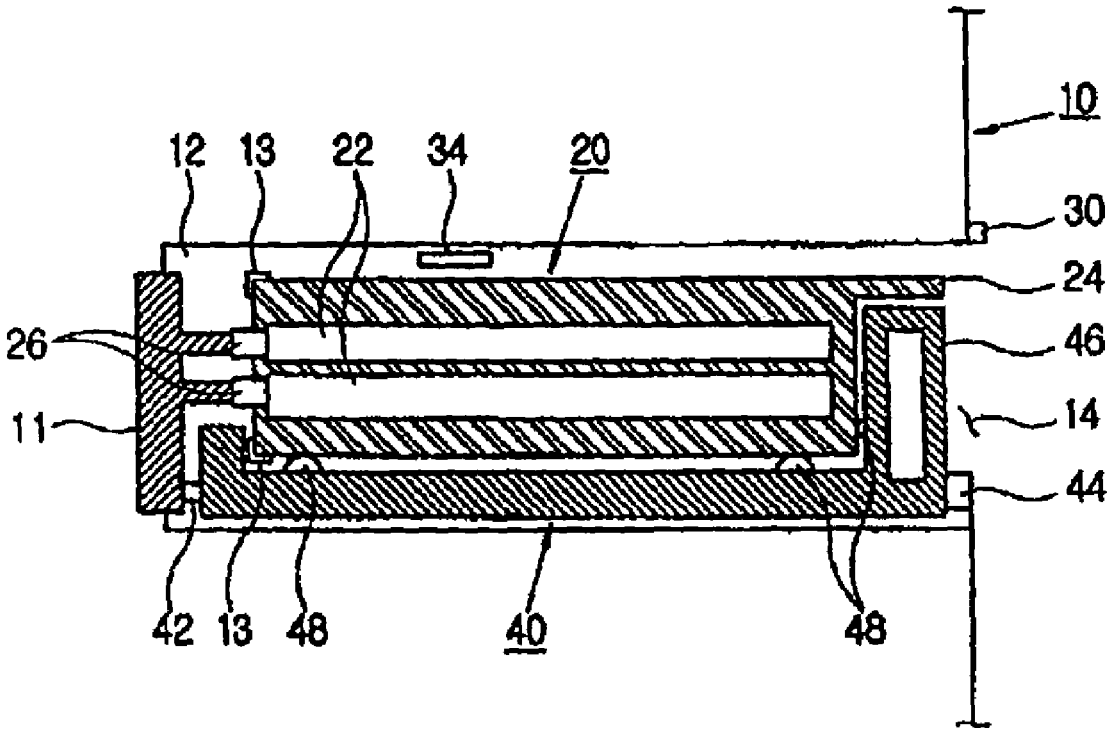
FIGS. 3A through 3C illustrate different views of the electrophotographic image forming device of FIG. 2.
Figure 3B:
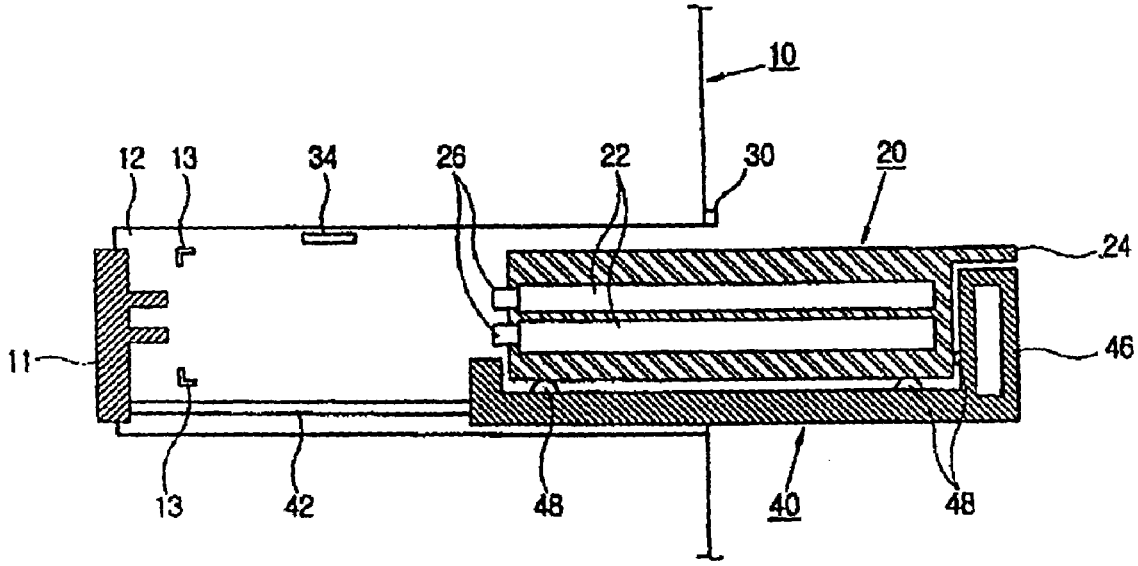
Figure 3C:
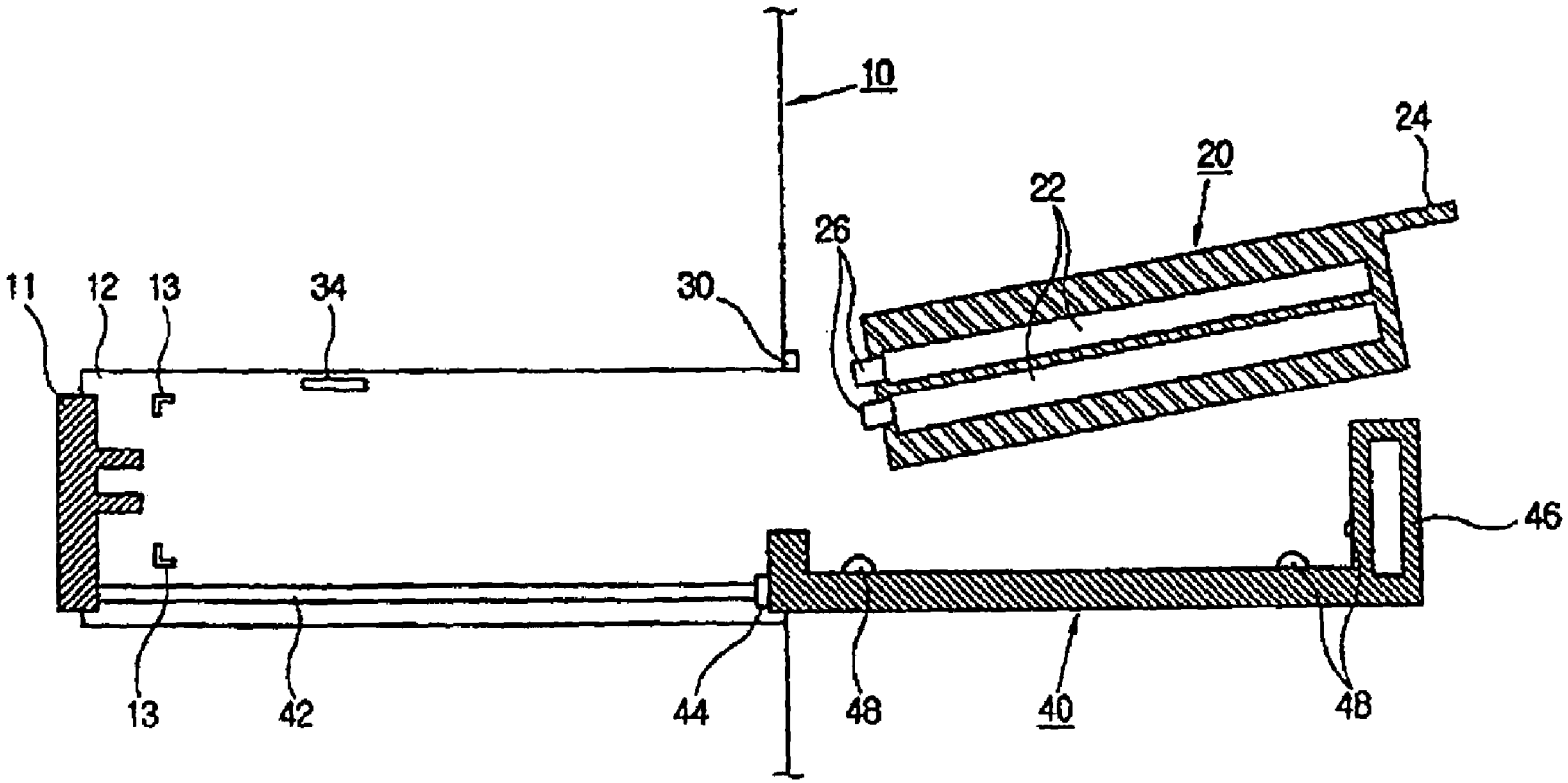

FIG. 2 illustrates an electrophotographic image forming device according to an embodiment of the present general inventive concept. FIG. 3A illustrates a state in which a fusing unit 20 is mounted in a housing 10 of the electrophotographic image forming device of FIG. 2. FIG. 3B illustrates a state in which the fusing unit 20 is being detached from the housing 10 of the electrophotographic image forming device of FIG. 2. FIG. 3C illustrates a state in which the fusing unit 20 is detached from the housing 10 of the electrophotographic image forming device of FIG. 2. Since FIGS. 3A through 3B all illustrate different states of the electrophotographic image forming device of FIG. 2, the embodiments of the present general inventive concept will be described with reference to FIGS. 2, and 3A through 3B. Referring to FIGS. 2, 3A, 3B, and 3C, the electrophotographic image forming device comprises the fusing unit 20 having a fusing roller 22, the housing 10 having a fusing unit accommodating part 12 to slidably accommodate the fusing unit 20 along a rotational axis of the fusing roller 22 (i.e., direction B) and a fusing unit gateway 14, and a movable fusing unit supporting part 40 to movably support the fusing unit 20.

The fusing unit 20 comprises the fusing roller 22 to receive a paper from an image forming unit (not shown) and to fix a developer thereon. The fusing roller 22 includes a heating part, and fixes the developer on the paper by applying heat and pressure thereto, thereby forming an image thereon.

The fusing unit 20 comprises a handle 24 formed at an end thereof extending in a detachment direction along which the fusing unit 20 is detached from the housing 10. The handle 24 makes it convenient for a user to hold the fusing unit 20 when mounting/detaching the fusing unit 20 in/from the housing 10. The fusing unit 20 further comprises a connecting part 26 formed on the other end thereof extending in an entrance direction along which the fusing unit 20 enters the housing 10. The connecting part 26 may receive power, a driving force, an electric signal, etc. from a delivering part 11 formed on the fusing unit accommodating part 12 and attached to the connecting part 26.

The housing 10 contains the image forming unit (not shown). The housing 10 comprises the fusing unit accommodating part 12 to slidably accommodate the fusing unit 20 along the rotational axis of the fusing roller 22, and the fusing unit gateway 14 positioned at an end of the fusing unit accommodating part 12 through which the fusing unit 20 is mounted or detached.

The fusing unit 20 enters the housing 10 through the fusing unit gateway 14, and is mounted on and off the fusing unit accommodating part 12 by being slided along the rotational axis of the fusing roller 22. Accordingly, when mounting or detaching the fusing unit 20 in or from the housing 10, the user can hold the handle 24 thereof (see FIG. 3C), which is as far from the fusing roller 22 as possible. Accordingly, the user can avoid getting burned even when the fusing roller 22 is very hot.

The fusing unit accommodating part 12 comprises the delivering part 11. The delivering part 11 is connected with the connecting part 26 as the fusing unit 20 is slidably accommodated in the fusing unit accommodating part 12. When the fusing unit 20 is accommodated in the fusing unit accommodating part 12, the delivering part 11 is connected to the connecting part 26, and the delivering part 11 supplies the fusing unit 20 with a power, a driving force, an electric signal, etc. used to perform the fusing operation.

Herein, the direction along which the fusing unit 20 is accommodated in the fusing unit accommodating part 12 is the same as a direction along which the connecting part 26 is connected to the delivering part 11. Thus, as the fusing unit 20 is accommodated in the fusing unit accommodating part 12, the connecting part 26 may be stably connected to the delivering part 11 automatically. The connecting part 26 may be connected with the delivering part 11 by an ordinary connection mechanism that is capable of delivering the power, driving force, electrical signal, etc. For example, the connecting part 26 may be connected to the delivering part 11 by a connector, a coupling, a gear, or the like.

The movable fusing unit supporting part 40 detachably supports the fusing unit 20, and is movably installed in the fusing unit accommodating part 12. The movable fusing unit supporting part 40 moves between a mounting position where the fusing unit 20 is accommodated in the fusing unit accommodating part 12 (as illustrated in FIG. 3A) and a detaching position where the fusing unit 20 is exposed outside the housing 10 through the fusing unit gateway 14 (as illustrated in FIG. 3C).

Thus, the movable fusing unit supporting part 40 allows the fusing unit 20 to be safely detachably accommodated in the fusing unit accommodating part 12, and prevents the fusing unit 20 from falling when the fusing unit 20 is discharged out of the housing 10 through the fusing unit gateway 14.

The movable fusing unit supporting part 40 comprises a holding part 46. The holding part 46 allows the user to move the movable fusing unit supporting part 40 in and out of the fusing unit accommodating part 12 without difficulty. The movable fusing unit supporting part 40 is provided with a fusing unit stopper 48 to fix the fusing unit 20 to the movable fusing unit supporting part 40 such that the fusing unit 20 does not move thereon. The fusing unit stopper 48 may be an ordinary fixing mechanism that can detachably fix the fusing unit 20.

The fusing unit accommodating part 12 comprises a rail part 42 to allow the movable fusing unit supporting part 40 to move smoothly between the mounting position and the detaching position. The rail part 42 may comprise a guide roller (not shown) to allow the movable fusing unit supporting part 40 to slide smoothly therealong. The rail part 42 may be located anywhere along a length of the fusing unit accommodating part 12 such that the movable fusing unit supporting part 40 can slide smoothly in and out of the fusing unit accommodating part 12. The rail part 42 may be formed on the movable fusing unit supporting part 40 and/or the fusing unit 20.

The rail part 42 comprises a deviation preventer 44 to prevent the movable fusing unit supporting part 40 from exceeding the detaching position and deviating from the housing 10. When the movable fusing unit supporting part 40 slides on the rail part 42 to an end portion of the fusing unit gateway 14 of the fusing unit accommodating part 12, the deviation preventer 44 blocks any more outward motion of the movable fusing unit supporting part 40, thereby preventing outward sliding thereof. The deviation preventer 44 may be an ordinary locking mechanism. The deviation preventer 44 may be formed on at least one of the rail part 42, a portion of the fusing unit accommodating part 12, and a portion of the housing 10.

A mounting position regulator 13, interposed between the fusing unit accommodating part 12 and the fusing unit 20, regulates a position in which the fusing unit 20 is accommodated in the mounting position. When the fusing unit 20 is accommodated in the fusing unit accommodating part 12, the mounting position regulator 13 regulates the position of the fusing unit 20 so that the connecting part 26 of the fusing unit 20 may be stably connected to the delivering part 11 of the fusing unit accommodating part 12. Thus, the fusing unit 20 may be integrated with the image forming unit (not shown), etc. contained in the housing 10.

The mounting position regulator 13 may regulate the position of the fusing unit 20 indirectly by regulating a position of the movable fusing unit supporting part 40 by contacting the movable fusing unit supporting part 40 directly. Further, the mounting position regulator 13 may be formed anywhere and in any shape to be interposed between the fusing unit accommodating part 12 and the fusing unit 20 in order to regulate the position of the fusing unit 20.

The fusing unit accommodating part 12 comprises a fusing unit mounting sensor 34 (see FIGS. 3A to 3C) to sense a state of the fusing unit 20 including whether the fusing unit 20 is accommodated in the fusing unit accommodating part 12. A controlling part (not shown) receives information regarding the state of the fusing unit 20 from the fusing unit mounting sensor 34 and indicates the state of the fusing unit 20 using an indicating part 32 (see FIG. 2).

The controlling part (not shown) controls the delivering part 11. In particular, the controlling part (not shown) controls the delivering part 11 not to supply the fusing unit 20 with the power, the driving force, etc. when the fusing unit 20 is not accommodated in the fusing unit accommodating part 12. The fusing unit mounting sensor 34 may be positioned on/in the housing 10 or on the fusing unit accommodating part 12 to sense whether the fusing unit 20 is accommodated in the fusing unit accommodating part 12. Alternatively, the fusing unit mounting sensor 34 may be positioned at other locations of the electrophotographic image forming device. The fusing unit mounting sensor 34 may be a photo sensor, a position sensor, or the like.

The housing 10 comprises a gateway cover 16 (see FIG. 2) coupled to the housing 10 by a hinge 18 to be rotated with respect to the hinge 18, thereby opening and closing the fusing unit gateway 14. A gateway sensor 30 senses a state of the gateway cover 16 including whether the gateway cover 16 is open. The controlling part (not shown) receives information regarding the state of the gateway cover 16, and indicates the state of the gateway cover 16 using the indicating part 32. Thus, the user can determine whether the gateway cover 16 is open and act accordingly.

The controlling part (not shown) may turn off the power for both the fusing unit 20 and the fusing unit accommodating part 12, or for the entire electrophotographic image forming device when the received information about the state of the gateway cover 16 indicates that the gateway cover 16 is open. Thus, the user may be prevented from touching the fusing unit 20, the fusing unit accommodating part 12, or any other components disposed in the housing 10 and receiving a burn or an electric shock therefrom.

A fusing unit, according to various embodiments of the present general inventive concept, is detachably accommodated in a fusing unit accommodating part along a rotational axis of a fusing roller. More generally, however, the fusing unit according to embodiments of the present general inventive concept may be detachably accommodated along a direction that is different from a paper transfer direction. As the fusing unit is detachably accommodated along any direction except for the paper transfer direction, an entire length of the fusing roller may be unexposed to a user, and the user may be prevented from contacting the fusing roller, which is typically very hot, and getting burned. Thus, the various embodiments of the present general inventive concept, allow the fusing unit to be safely detachably mounted in the housing.

Additionally, in another embodiment of the present general inventive concept, a fusing unit gateway may be omitted. The fusing unit may be detachably accommodated in the fusing unit accommodating part by dismantling or assembling a portion of the housing. The fusing unit of these embodiments may also be safely detachably mounted in the housing.

Additionally, in another embodiment of the present general inventive concept, a gateway cover may be omitted. The fusing unit may be configured such that a portion thereof (i.e., an end) may close the fusing unit gateway itself when the fusing unit is accommodated in the fusing unit accommodating part. Furthermore, in some embodiments of the present general inventive concept that include the gateway cover, the gateway cover may be coupled to the housing by a hinge to rotatably open and close the fusing unit gateway. Alternatively, the gateway cover may be a sliding door that is coupled to the housing to open and close the fusing unit gateway. Further, the gateway cover may be separably coupled to the housing.

In another embodiment of the present general inventive concept, a movable fusing unit supporting part and/or a rail part may be omitted. In these embodiments, the fusing unit may be accommodated in the fusing unit accommodating part by sliding the fusing unit on the fusing unit accommodating part itself.

The electrophotographic image forming device according to the various embodiments of the present general inventive concept may be a printer, a photocopier, a facsimile, a multifunction device, or the like. Additionally, the electrophotographic image forming device according to the present general inventive concept may be a wet type of electrophotographic image forming device for which a liquid developer is used, or a dry type of electrophotographic image forming device for which a powdery developer, such as a toner, is used.

Further, the electrophotographic image forming device according to the various embodiments of the present general inventive concept may be a black and white electrophotographic image forming device or a color electrophotographic image forming device. Furthermore, the electrophotographic image forming device according to the various embodiments of the present general inventive concept may be a one side printing electrophotographic image forming device or a two side printing electrophotographic image forming device.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electrophotographic image forming device having an image forming unit to apply a developer to a paper to form an image thereon, comprising:

a fusing unit having a fusing roller to receive the paper from the image forming unit, to fix the developer on the paper, and to move the paper in a paper transfer direction;

a housing containing the image forming unit, and having a fusing unit accommodating part to detachably receive the fusing unit along a direction that is different than the paper transfer direction to be accommodated therein and along a rotational axis of the fusing roller;

a movable fusing unit supporting part movably installed or fastened in the fusing unit accommodating part to detachably support the fusing unit disposed thereon;

a mounting position regulator interposed between the fusing unit accommodating part and the fusing unit to regulate a position in which the fusing unit is accommodated therein; and a rail part interposed between the movable fusing unit supporting part and the fusing unit accommodating part to allow the movable fusing unit supporting part to move smoothly between the mounting position and the detaching position, wherein the movable fusing unit supporting part is installed to move between a mounting position in which the fusing unit is accommodated in the fusing unit accommodating part and a detaching position in which the fusing unit is exposed out of the housing and is detachable therefrom by being moved through the fusing unit gateway.

2. The electrophotographic image forming device according to claim 1, wherein the rail part comprises a deviation preventer disposed at an end of the rail part in the fusing unit gateway to prevent the movable fusing unit supporting part from exceeding the detaching position and to prevent the movable fusing unit supporting part from deviating from the housing.

3. An electrophotographic image forming device having an image forming unit to apply a developer to a paper to form an image thereon, comprising:

a fusing unit having a fusing roller to receive the paper from the image forming unit, to fix the developer on the paper, and to move the paper in a paper transfer direction;

a housing containing the image forming unit, and having a fusing unit accommodating part to detachably receive the fusing unit along a direction that is different than the paper transfer direction to be accommodated therein and along a rotational axis of the fusing roller;

a movable fusing unit supporting part movably installed or fastened in the fusing unit accommodating part to detachably support the fusing unit disposed thereon; and a mounting position regulator interposed between the fusing unit accommodating part and the fusing unit to regulate a position in which the fusing unit is accommodated therein, wherein the movable fusing unit supporting part is installed to move between a mounting position in which the fusing unit is accommodated in the fusing unit accommodating part and a detaching position in which the fusing unit is exposed out of the housing and is detachable therefrom by being moved through the fusing unit gateway, and comprises a holding part at an end thereof that corresponds to the fusing unit gateway when in the mounting position.

4. An electrophotographic image forming device having an image forming unit to apply a developer to a paper to form an image thereon, comprising:

a fusing unit having a fusing roller to receive the paper from the image forming unit, to fix the developer on the paper, and to move the paper in a paper transfer direction;

a housing containing the image forming unit, and having a fusing unit accommodating part to detachably receive the fusing unit along a direction that is different than the paper transfer direction to be accommodated therein and along a rotational axis of the fusing roller;

a movable fusing unit supporting part movably installed or fastened in the fusing unit accommodating part to detachably support the fusing unit disposed thereon; and a mounting position regulator interposed between the fusing unit accommodating part and the fusing unit to regulate a position in which the fusing unit is accommodated therein, wherein the housing further comprises a fusing unit gateway positioned at an end of the fusing unit accommodating part to allow the fusing unit to be moved in and out of the fusing unit accommodating part therethrough, a gateway cover to open or close the fusing unit gateway and a gateway sensor to sense a state of the gateway cover including whether the gateway cover is open.

5. The electrophotographic image forming device according to claim 4, further comprising:

an indicating part to indicate the state of the fusing unit; and a controlling part to receive the state of the fusing unit from the fusing unit mounting sensor and to control the indicating part to indicate the state of the fusing unit.

6. A fusing device usable in an electrophotographic image forming device and to be integrated with components installed in a housing thereof, the fusing device comprising:

a fusing unit having one or more fusing rollers to apply heat and pressure to a paper;

a movable support part to movably and detachably support the fusing unit disposed thereon between a mounted position in which the movable support part supports the fusing unit in the housing and a detached position in which the movable support part supports the fusing unit out of the housing;

an accommodating part in which the movable support part is slidably disposed to extend along a rotational axis of the one or more fusing rollers perpendicular to a paper transfer direction in which the paper is transferred when the fusing unit is in the mounted position; and a mounting position regulator interposed between the fusing unit accommodating part and the fusing unit to regulate a position in which the fusing unit is accommodated therein, wherein the fusing unit is received in the housing along a rotational axis of the one or more fusing rollers and, the accommodating part comprises a connection end, an entrance end and a deviation preventer to prevent the movable support part from deviating from the housing such that in the detached position a small portion of the movable support part is disposed in the housing at the entrance end of the accommodating part and a large portion of the movable support part extends out of the housing and supports the fusing unit therein.

7. A fusing device usable in an electrophotographic image forming device and to be integrated with components installed in a housing thereof, the fusing device comprising:

a fusing unit having one or more fusing rollers to apply heat and pressure to a paper;

a movable support part to movably and detachably support the fusing unit disposed thereon between a mounted position in which the movable support part supports the fusing unit in the housing and a detached position in which the movable support part supports the fusing unit out of the housing;

an accommodating part in which the movable support part is slidably disposed to extend along a rotational axis of the one or more fusing rollers perpendicular to a paper transfer direction in which the paper is transferred when the fusing unit is in the mounted position; and a mounting position regulator interposed between the fusing unit accommodating part and the fusing unit to regulate a position in which the fusing unit is accommodated therein, wherein the fusing unit is received in the housing along a rotational axis of the one or more fusing rollers, and the housing comprises a rail part to slidably support the movable support part thereon and a first slide stop disposed at an entrance to the housing to prevent the movable support part from exiting the housing completely and a second slide stop disposed inside the housing to stop the movable support part from sliding therein when the movable support part reaches a position at which the fusing unit is in the mounted position.

8. A fusing device usable in an electrophotographic image forming device and to be integrated with components installed in a housing thereof, the fusing device comprising:

a fusing unit having one or more fusing rollers to apply heat and pressure to a paper;

a movable support part to movably and detachably support the fusing unit disposed thereon between a mounted position in which the movable support part supports the fusing unit in the housing and a detached position in which the movable support part supports the fusing unit out of the housing;

an accommodating part in which the movable support part is slidably disposed to extend along a rotational axis of the one or more fusing rollers perpendicular to a paper transfer direction in which the paper is transferred when the fusing unit is in the mounted position; and a mounting position regulator interposed between the fusing unit accommodating part and the fusing unit to regulate a position in which the fusing unit is accommodated therein;

a sensor disposed on the housing to determine at least one of a state of the fusing unit including whether the fusing unit is mounted in the housing and a state of an entrance cover that opens and closes an entrance to the housing in which the fusing unit is mountable including whether the entrance cover is open or closed; and a controller to control a power supply to the fusing unit according to the determined at least one of the state of the fusing unit and the state of the entrance cover such that the fusing unit is not supplied with power unless the fusing unit is mounted in the housing and the entrance cover is closed, wherein the fusing unit is received in the housing along a rotational axis of the one or more fusing rollers.

* * * * *